US005749126A

United States Patent [19]

Patelli et al.

[11] Patent Number: 5,749,126

[45] Date of Patent: May 12, 1998

[54] DEVICE FOR GUIDING AND COUPLING THE SLIDING FLAT WITH THE DRIVE BELT IN A FLAT CARD

[75] Inventors: Silvano Patelli; Antonio Cossandi; Giovanni Battista Pasini, all of Palazzolo Sull'oglio, Italy

[73] Assignee: F.LLI Marzoli & C. S.p.A., Bergamo, Italy

[21] Appl. No.: 810,371

[22] Filed: Mar. 3, 1997

[30] Foreign Application Priority Data

Mar. 4, 1996 [IT] Italy ..... M196A0414

[51] Int. Cl.[6] ..... D01G 15/08

[52] U.S. Cl. ..... 19/102; 19/98; 19/111; 19/113

[58] Field of Search ..... 19/102, 103, 98, 19/104, 111, 113, 110

[56] References Cited

U.S. PATENT DOCUMENTS

| | | | |
|---|---|---|---|
| 4,559,674 | 12/1985 | Rimmer et al. | 19/111 |
| 4,757,575 | 7/1988 | Varga | 19/111 |
| 4,987,647 | 1/1991 | Von Gehlen | 19/110 |
| 5,473,795 | 12/1995 | Spix et al. | 19/113 |
| 5,542,154 | 8/1996 | Demuth et al. | 19/113 |

FOREIGN PATENT DOCUMENTS

| | | |
|---|---|---|
| 0066386 | 5/1982 | European Pat. Off. . |
| 0567747 | 3/1993 | European Pat. Off. . |
| 0627507 | 5/1994 | European Pat. Off. . |
| 0693584 | 7/1995 | European Pat. Off. . |

OTHER PUBLICATIONS

EP Search Report of Sep. 18, 1996.

*Primary Examiner*—Peter Nerbun
*Assistant Examiner*—Larry D. Worrell, Jr.
*Attorney, Agent, or Firm*—Diller, Ramik & Wight, PC

[57] ABSTRACT

A carding flat and a system for guiding and driving it in a card with moving flats driven by toothed belts, in which coupling between the flats and belts is achieved by a form fit between cavities and projections without fixed retention means, so enabling these elements to freely rotate about the coupling axis.

16 Claims, 7 Drawing Sheets

BEST AVAILABLE COPY

DEVICE FOR GUIDING AND COUPLING THE SLIDING FLAT WITH THE DRIVE BELT IN A FLAT CARD

BACKGROUND OF THE INVENTION

This invention relates to cards with sliding flats in which fibrous material in thin layer form is worked by a series of surfaces provided with a plurality of points of various shape, inclination and rigidity and driven to move relative to each other, in which the fibrous material is opened into single fibre form, the small trash particles being eliminated together with waste and tangles, the fibres undergoing mutual mixing to form a sliver of untwisted fibres to be fed to the subsequent working stages.

DESCRIPTION OF RELATED ART

To highlight the technical problems involved in carding and confronted by the present invention, the flat carding process is described briefly with reference to the carding machine of FIG. 1. The raw material 1 consisting of staple fibres collected into the form of a web of approximately rectangular cross-section is fed to the machine by a feed roller 2 which presses and controls it against the board 3 to feed a strip 4 to the opening cylinder 5. The opening cylinder 5 is provided with clothing, i.e. points inclined opposite the direction of opening cylinder rotation, and is driven at a considerable rotational speed. The fibre strip 4 is hence roughly combed and distributed over the opening cylinder 5 into a layer thinner than the original layer 1. During its anticlockwise rotation the fibre layer encounters clothed segments and blades for removing impurities, after which the fibres pass to the subsequent carding drum 6. The drum 6 is driven at a rotational speed less than the opening cylinder 5, but as it has a much larger diameter its peripheral speed is higher. The points on the drum 6 are also inclined in the direction of rotation, to remove the fibres from the surface of the opening cylinder 5 along the closest generating lines between the opening cylinder 5 and the carding drum 6. The moving flats 7 are located above the top of the drum 6. The moving flats 7 are in the form of bars having a length corresponding to the generating line of the carding drum 6 and a few centimeters in width. That part thereof which faces the drum 6 is provided with clothing in the form of points pointing in the direction of movement. Generally the moving flats 7 move slowly in a direction of rotation which is the same as or opposite to the that of the drum 6. The two clothings cooperate with typical carding action to provide fibre extension, cleaning, retention and depth control within the point clothing. It should however be noted that the peripheral drum speed is generally within the range of 15–40 meters per second, whereas the flat speed is of the order of a few millimeters per second.

The flats 7 circulate about the drum periphery conveyed by a drive member, for example a pair of chains 8 circulating about a series of drive and guide sprockets 9. Along the carding path between the drum 6 and flats 7, the flats 7 are guided by guides 10 which are preset with a precision of the order of a tenth and even down to a hundredth of a millimeter, to establish the distances between the drum clothing and the flat clothing, which are essential for the good outcome of the operation. The guides 10 are positioned at the edge of the flat faces of the drum 6, and on them there slide the end parts, without points, of the flats 7. The extended and cleaned fibres become arranged into a thin layer on the carding drum 6.

They are then detached by a discharge cylinder 11, also provided with points inclined in the direction of rotation, to enable the fibres carded by the drum 6 to be withdrawn and then discharged from the cylinder 11 by detachment cylinders not shown in the figure.

The present invention relates in particular to an improved sliding flat for said flat cards and a system for guiding and driving it. In the traditional art the flats are generally driven by drive chains 8 to which the flats are fixed by means of bushes, brackets and various supports, either on the chain joints or plates, by screw elements, by snap rings, form fits and so on. European patent application 92/201945 in the name of the present applicant describes and claims various form fits between flats and chains without fixed means for retention in the direction perpendicular to the chain movement, with high accuracy in the direction of the guides 10 and with the facility for removal even with the machine in motion.

In the traditional art the bodies of the flats are generally constructed of ferrous material by casting, typically of cast iron, to which the point clothing for the carding is then applied.

This type of construction satisfies the requirements of reliability, reproducibility, rigidity and life, but at the cost of an overall very heavy structure which results in considerable construction, installation and maintenance costs of the overall machine.

For these reasons the current tendency of the art is to pursue a lighter and more economical construction, for example by using card flat bodies produced from aluminium or light alloy sections, on which the card clothing is then fixed. These flats, formed from hollow sections of suitable moment of inertia, satisfy the need for good flexural and torsional rigidity, and are lighter and overall less costly even though a more valuable material is used. These light flats allow, inter alia, the general architecture of the machine to be modified, and enable toothed belt drives to be used instead of traditional metal chains.

European patent application EP-A-361 219 of Truetzschler GmbH describes a flat card system of this type. European patent application EP-A-567 747, again of Truetzschler GmbH, describes the insertion of stronger cylindrical pins into the external parts of the flats so that these pins would rest on the guides 10 instead of the ends of the light alloy section, which would wear more rapidly. These pins can be constructed of more wear-resistant materials and can be replaced during periodic machine maintenance at low cost.

European patent application EP-A-627 507 of Maschinenfabrik Rieter AG describes a flat card system of this type with coupling between the flat and the toothed drive belt by means of the actual pins which slide on the guides 10.

The technical arrangements of the cited prior patents have the drawback that the coupling between the card flat and the toothed drive belt is such as to angularly constrain the flat to the belt, so endangering the accuracy with which the flat can follow the guides 10 directionally, given that the belt has a certain intrinsic rigidity.

SUMMARY OF THE INVENTION

An object of the invention is to provide an improved lightweight flat for said flat cards, and a system for guiding and driving it which uses a toothed belt drive but without the stated drawbacks of this type of drive when used in the aforesaid systems. A further object of the present invention is to provide a coupling system between the flat and belt which enables said elements to be easily released from each other for maintenance and for removal during maintenance.

According to the present invention, coupling between the flat and toothed belt is provided only in the direction of movement of the flats, while leaving said elements not coupled together in the direction perpendicular to the movement of the flats, by means of a cylindrical form fit between the flats and chain using recesses and projections of circular cross-section, without fixed means for retaining them in position, and which enables the flat to freely position itself in the direction of the guide 10 without angular constraints caused by the cylindrical coupling with the toothed belts positioned at its ends.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
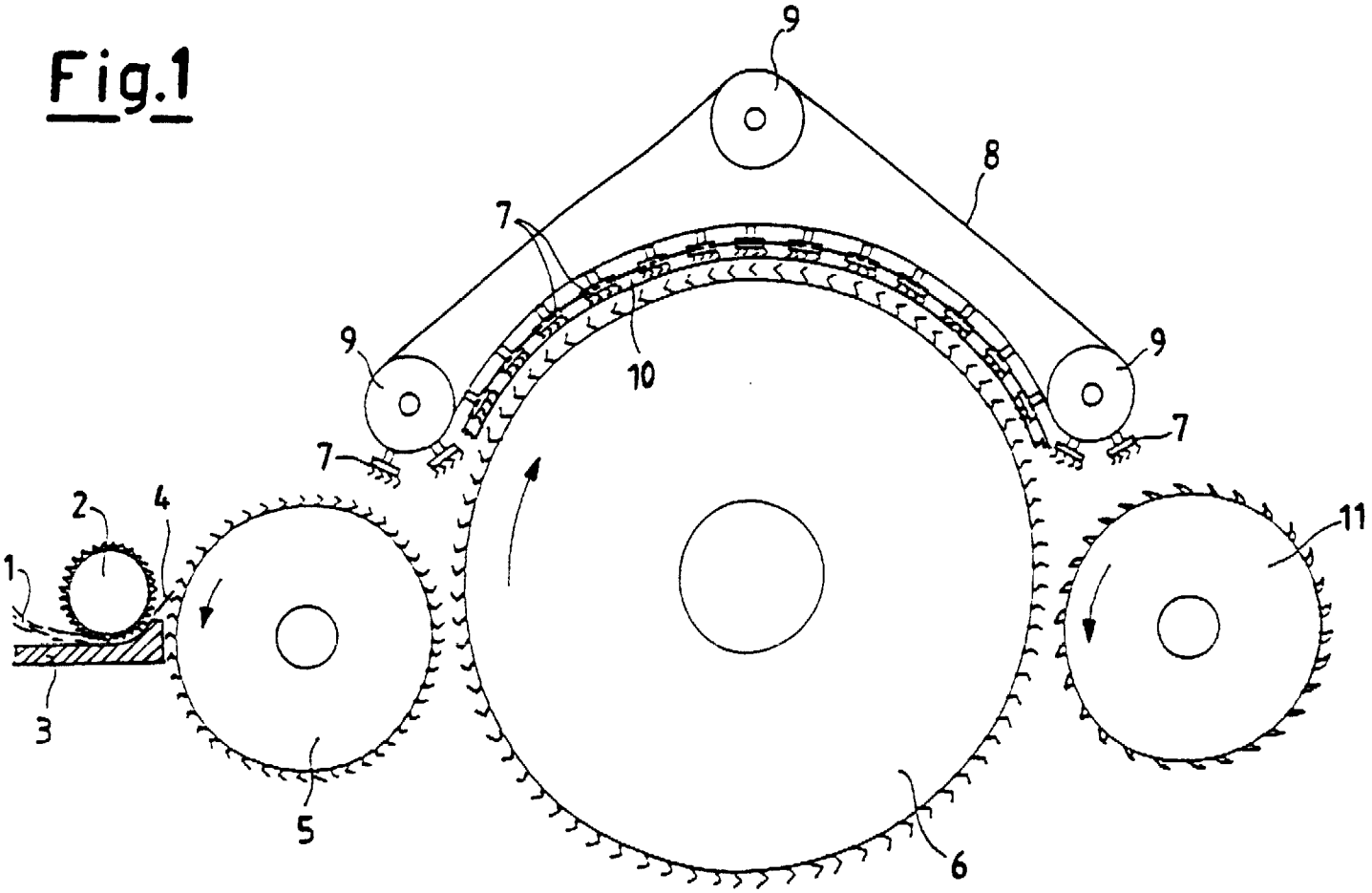
FIG. 1 is a highly schematic side elevational view, and illustrates a conventional carding machine including an opening cylinder, a carding drum, a discharge cylinder and a plurality of flats in opposition to an upper portion of the carding drum.
Figure 2C:
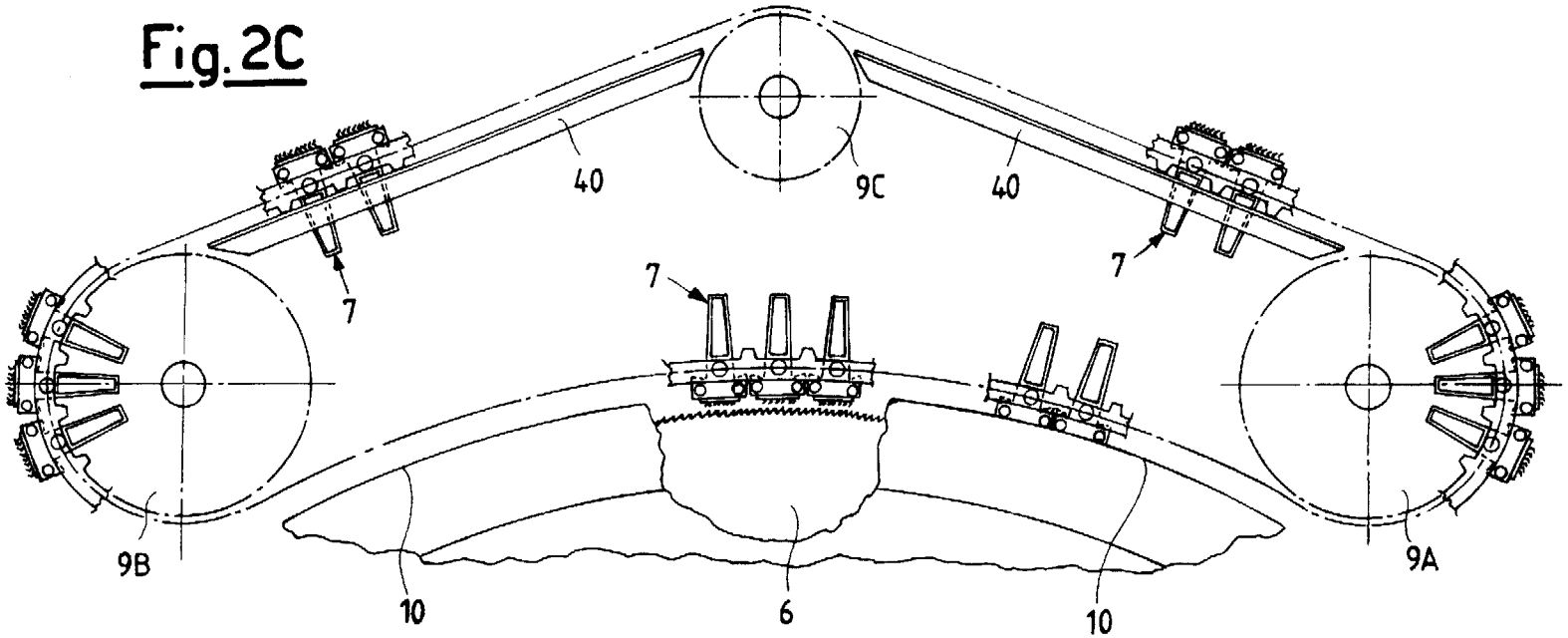
FIG. 2C is a fragmentary side elevational view of an upper portion of the carding machine of the first embodiment of the invention, and illustrates the manner in which the flats are guided during travel along upper and lower drive belt flights.
Figure 2B:
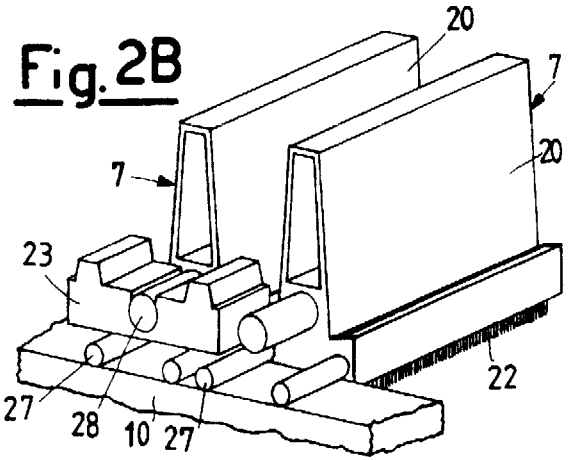
FIG. 2B is fragmentary perspective view of the first embodiment of the invention, and more clearly illustrates details of the coupling pins and cavities and additional pairs of guide pins carried by the flats.
Figure 2D:
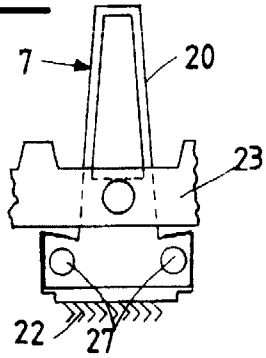
FIG. 2D is a diagrammatically side elevational view of one of the flats and drive belts, and illustrates details thereof.
Figure 2A:
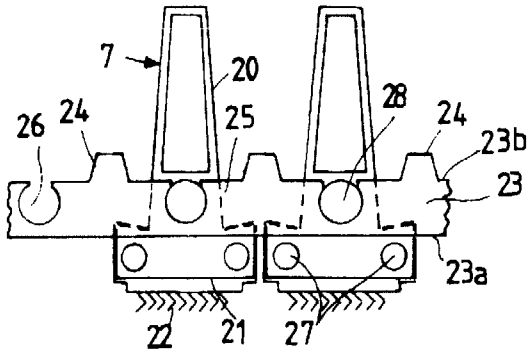
FIG. 2A is a fragmentary side elevational view of a portion of a carding machine of a first embodiment of the invention, and illustrates a toothed belt having alternating teeth and valleys with the valleys having cylindrical cavities receiving cylindrical pins axially projecting from associated flats.
Figure 5B:
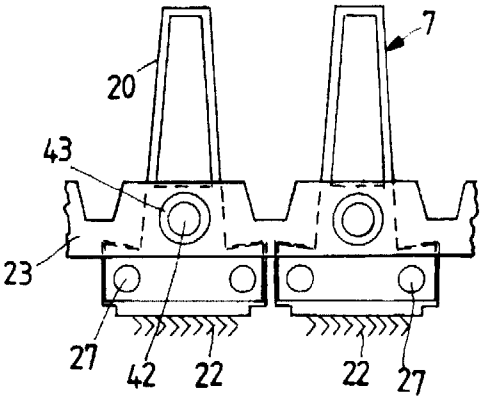
FIG. 5B is a side elevational view of the embodiment of the invention illustrated in FIG. 5A, and illustrates details thereof.
Figure 5D:
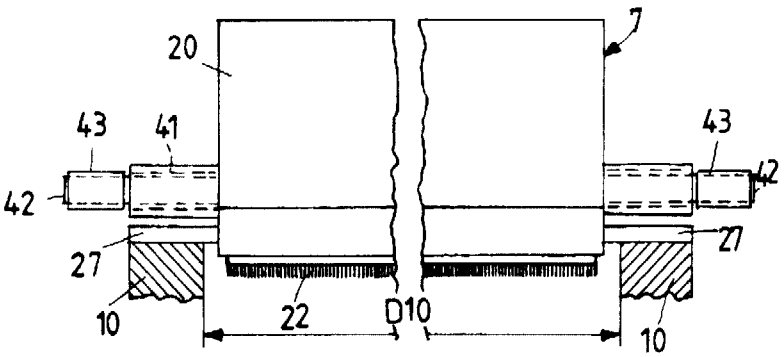
FIG. 5D is a fragmentary cross-sectional view similar to FIG. 5C, and illustrates the pairs of guide pins supported by the lower guides associated with the carding drum.
Figure 5A:
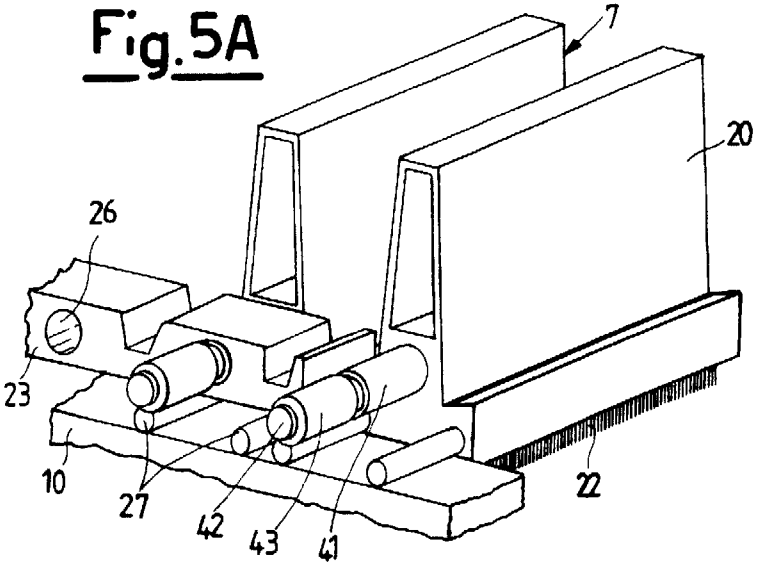
FIG. 5A is a fragmentary perspective view, and illustrates another embodiment of the invention in which the coupling cavities are located between upper and lower faces of the drive belt and ends of the coupling pins project therethrough and carry anti-friction bearings.

The flat 7 of FIGS. 2A through 2C is preferably of inverted T cross-section to provide sufficient rigidity against flexural stress between the two guide supports 10, which are spaced apart transversely by a distance $D_{10}$ (FIG. 5D) of the order of one meter. The shank 20 of the T is made hollow to achieve a high flexural moment of inertia. The body of the flat 7 is obtained from a light alloy section of indefinite length, which is cut to size to a length less than the distance between the guides 10. A lower face 21 of each flat 7 is not involved with the guides 10 and carries the card clothing 22 (FIG. 2B) indicated roughly as a series of points. The toothed belt 23 has a flat lower face **23*a* and an undulating upper face 23*b*. Generally each toothed belt 23** is constructed of material of good flexibility, such as elastomeric materials possibly reinforced longitudinally with textile fibre threads and/or metal wires.

On the worked face **23*b* of each toothed belt 23 there is provided a series of projecting teeth 24 intended to engage the sprockets 9A, 9B and 9C, and spaced apart by a series of lower longer portions 25, in which there is provided an upwardly open cylindrical cavity 26 of circular cross-section for housing a horizontal pin or element 28 by which the toothed belts 23 are coupled to the flats 7. On the terminal faces at the two ends of the body of the flats 7, and in particular on the part forming the "cross-member of the T", there are fixed in a position closer to the face 21 two pins 27 of wear-resistant material, for example alloy steel, which are positioned horizontally and intended to slide on the card guides 10 to support the working flats 7 facing the drum 6**.

Again on the terminal faces of the body of the flats 7, but in a position relatively further from the lower face 21, there is fixed a horizontal pin 28 for insertion into the cylindrical cavity 26. The pin 28 is of cylindrical shape and has a size corresponding to the size of said cavity 26, not only to enable the flat 7 to be driven along its working path but also to enable it to undergo adaptive rotary movements via the pin 28 within the cavity 26, to enable the flat to guide accurately along to the profile of the guides 10.

To allow freedom of said rotational movements in adapting to the path determined by the guides 10, in a preferred embodiment of the invention the support pins 27 are mounted at a substantial distance from the bottom face 23*a* of the toothed belt 23.

In other words, between the flat 7 and the toothed belt 23 there is provided a cylindrical form fit, without fixed retention means, with the toothed belts positioned at its ends by means of cavities 26 and pins 28 of circular cross-section having their axes transverse to the toothed belt, by which the flat 7 is free to adapt itself angularly by rotating about the coupling axis in the direction of the guide 10 without angular constraints provided by the cylindrical fit.

The pins 27 and 28 can be fixed to the body of each flat 7 in known manner, for example by a forced fit or by a screwed connection.

Figure 3C:
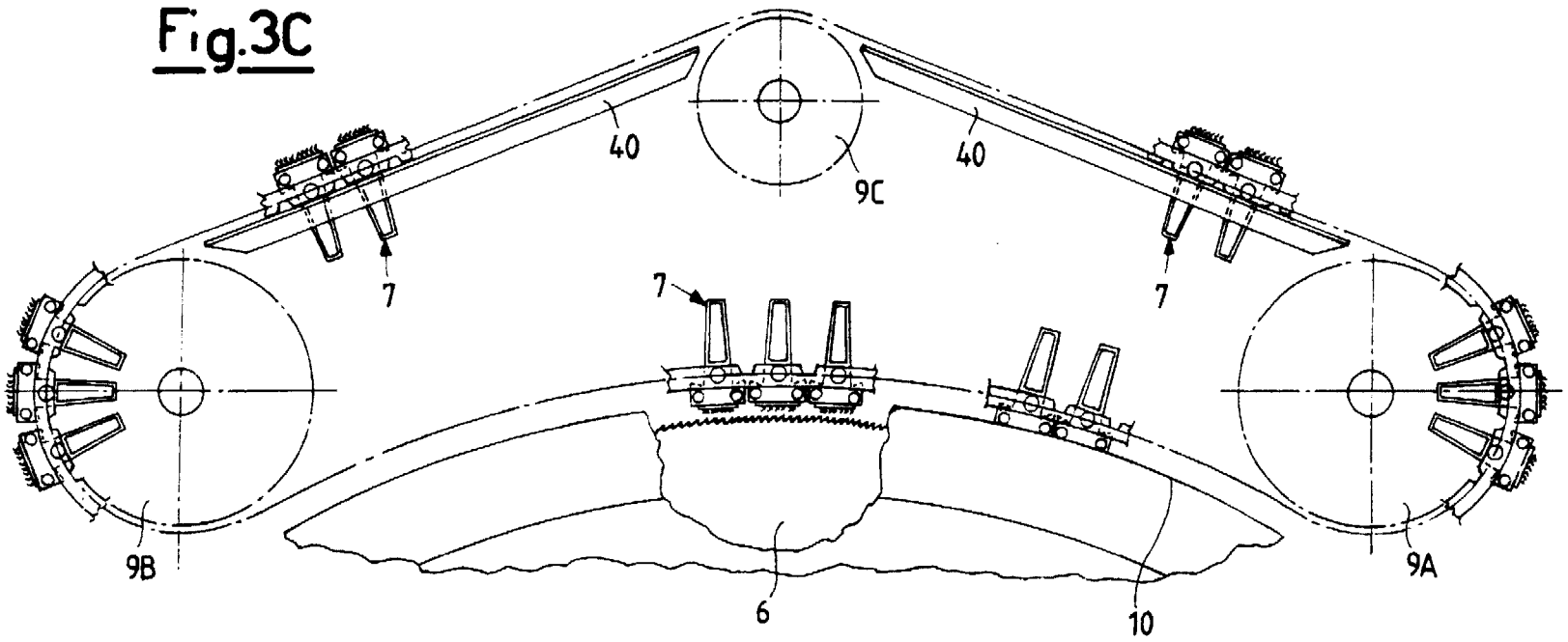
FIG. 3C is a fragmentary side elevational view of an upper portion of the carding machine, and illustrates the manner in which the flats are guided during travel along upper and lower flights thereof.
Figure 3D:
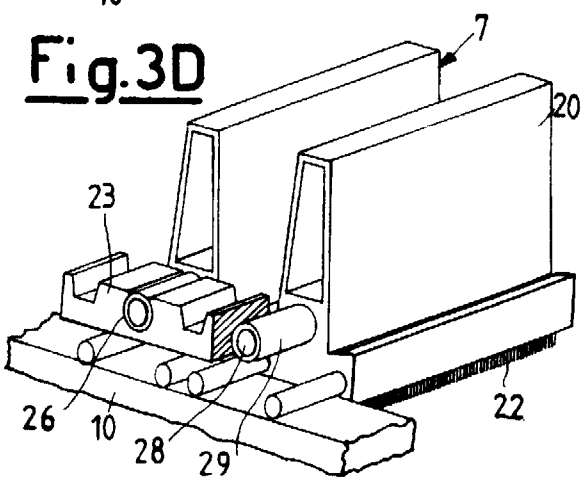
FIG. 3D is a fragmentary perspective view of another embodiment of the invention, and illustrates an anti-friction bearing carried by a cylindrical pin projecting from each of the flats.
Figure 3B:
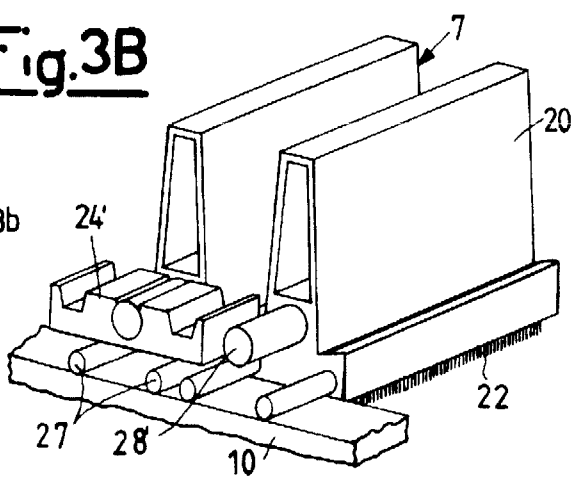
FIG. 3B is a fragmentary perspective view of the embodiment of the invention illustrated in FIG. 3A, and illustrates the details thereof including pairs of additional guide pins carried by each of the flats.
Figure 3A:
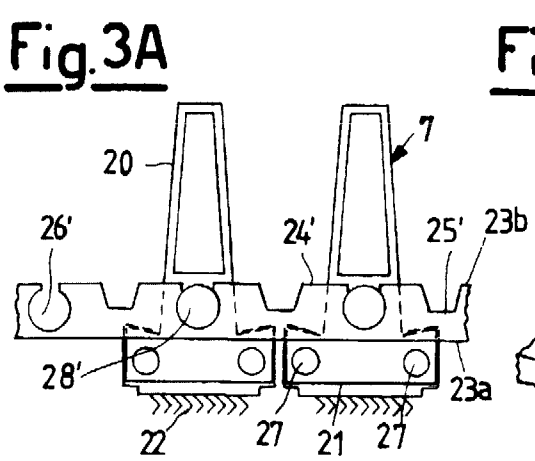
FIG. 3A is fragmentary side elevational view of another embodiment of the invention, and illustrates cylindrical coupling cavities in teeth of the drive belt coupling cylindrical pins of flats thereto.

The embodiment shown in FIGS. 3A, B, C shows a modification to the belt/flat coupling of FIGS. 2. In it, the worked face 23*b* of the belt 23 is provided with a series of projecting teeth 24' extending further in the longitudinal direction than the depressed portions 25'. Within the teeth 24' there is provided an upwardly open cylindrical cavity 26' intended to house the pin 28'. It can be seen that this embodiment requires a lesser belt thickness than the embodiment of FIG. 2. It also has further advantages which are described hereinafter.

FIG. 3D shows a preferred embodiment of the invention, applicable advantageously to the circular coupling pins of the other described embodiments, in which that part of the pin 28 projecting from the flat 7 is provided with an antifriction rolling bush 29, interposed between the pin 28 and its cavity 26, which reduces friction during mutual rotation.

Along the path guided by the guides 10, for which on the other side of the drum there is another corresponding guide 10 parallel to it, the series of flats 7 are driven by the toothed belts 23 which follow the path defined by the sprockets 9, of which at least one is motorized and at least one is provided with belt tensioning members. As in the case of the guides 10, the sprockets are also provided in pairs, one for each side of the drum 6.

With the coupling systems shown in the embodiments of FIGS. 2 and 3 when the flats separate from the guides 10, the toothed belts 23 retain the flats 7 during their engagement with the sprockets 9 until they have overturned with the clothing 22 on top. After this overturning each flat 7 is supported on the belt 23.

In FIGS. 4A,4B,4C and 4D a toothed belt 33 has its lower face 33*a* worked to engage the pins 28 and its upper face 33B toothed to engage the sprockets 9 by means of its teeth.

Figure 4C:
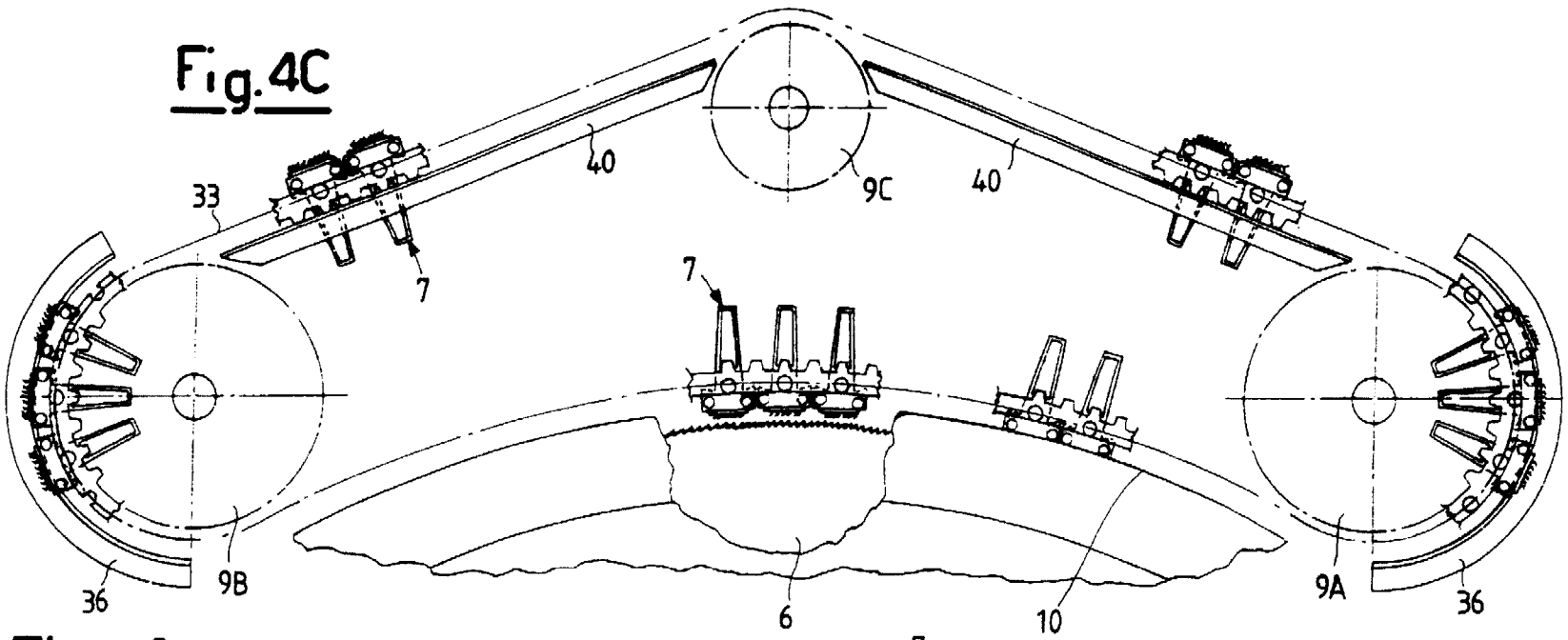
FIG. 4C is a fragmentary side elevational view of an upper portion of the carding machine, and illustrates the flats being guided during movement along upper and lower flights of the drive belts.
Figure 4D:
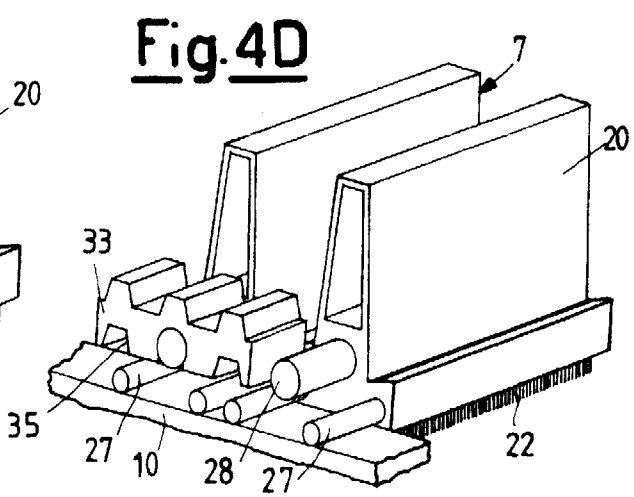
FIG. 4D is a fragmentary perspective view of a modification of the drive belt of FIGS. 4A through 4C, and illustrates downwardly opening channels formed in the drive belts for reducing the weight thereof.
Figure 4B:
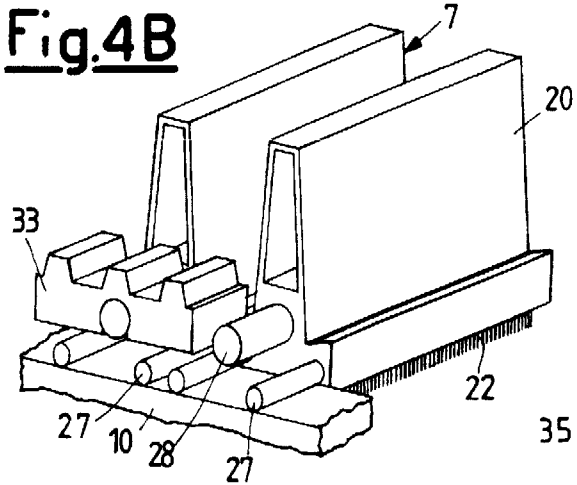
FIG. 4B is a fragmentary perspective view of the carding machine of FIG. 4A, and illustrates details thereof including additional pairs of guide pins carried by each flat.
Figure 4A:
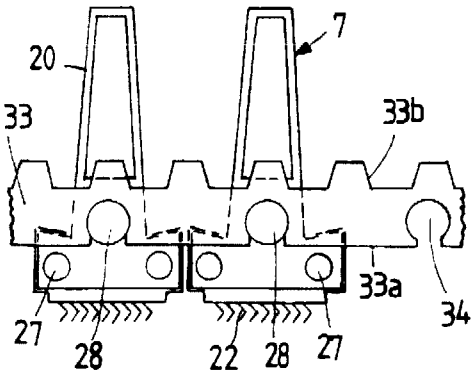
FIG. 4A is a fragmentary side elevational view of another embodiment of the invention, and illustrates cylindrical pins carried by flats coupled to cylindrical coupling cavities in an associated drive belt which open through lower faces of the drive belt.

In the lower face 33*a* there is provided a series of downwardly open cylindrical cavities 34 intended to house the coupling element 28 for the flats 7. In the embodiment of FIG. 4D, the toothed belt 33 is made more flexible and lighter by a series of weight reducing cavities 35, which alternate with the coupling cavities 34.

It should be noted that in the aforedescribed embodiments the cavities 26, 26', 34 are formed with an open cylindrical section, resulting in easier connection between the toothed belt 23 or 33 and the flat 7. It is also possible to form the device of the present invention with the cavities 26, 26', 34 of closed cylindrical section, as shown in particular in FIG. 2D, resulting in a connection with a greater guarantee of retention between the flat and the toothed belt, even if the belts are stressed to the extent of undergoing considerable deformation by elongation.

With the coupling system shown in the embodiments of FIGS. 4, when the flats separate from the guides 10 the toothed belts 33 do not retain the flats during their engagement with the sprockets 9, and consequently supplementary guides 36, of L cross-section and extending as a semicircle, are required to compel the series of flats 7 passing about the sprockets 9A, 9B on the belt 33 not to separate from them until they have overturned with the clothing 22 on top. This difference has however an advantageous side deriving from the fact that along their inoperative upper path from sprocket 9B to sprocket 9A the flats 7 always simply rest on the pair of belts 33. In this respect it must be noted that in carding, the material is such as to require the cylinders and the flats to be subjected to frequent cleaning and to regeneration of the clothing.

In consideration of this and of the large number of flats installed on the machine, of the order of a hundred, it is advantageous to be able to remove and replace a flat by simply lifting it from its site on the pair of belts along its upper path. In devices of the known art, the flats are generally removed and replaced with greater complication. In the embodiment of FIG. 4 each flat 7 is withdrawn without having to remove restrictions. If there are no particular safety regulations the flats 7 can even be removed when in movement, given their low peripheral speed and their instant removability.

Along the working lower path the belts 23, 33 are guided by the flats 7, which in their turn rest continuously on the guides 10. Along the inactive upper path the flats 7 rest on the toothed belts 23, 33, which are considerably stressed by the weight of the flats 7 and may not be able to by themselves support all the flats without dangerous elongation. For this reason, according to a preferred embodiment of the invention, the upper parts joining the sprockets 9A, 9C and 9B are provided with support guides 40 on which the inverted inoperative flats 7 are slidingly supported.

A further technical problem relating to the upper path of the guides 40 derives from the fact that the relative position between the belts 23, 33 and flats 7 is in this case inverted. The flats 7 rest on the belts 23, 33 which could slide on the guides 40, with considerable friction and wear.

According to a preferred embodiment of the present invention, the coupling pins 28, 28' between the belt and flat are made to project from their cavity 26, 26', 34 in the toothed belt 23, 33 such that they rest—with the flats inverted—on the return guides 40 in place of the projecting teeth 24, 24' of the toothed belt This improvement is illustrated with greater detail in the embodiments of FIGS. 5A through 5D and 6A through 6D, by way of non-limiting example. The embodiment of FIGS. 5A through 5D uses the type of coupling shown in FIGS. 3 in which however the coupling pin 41 between the belt 23 and flat 7 is constructed with a length projecting from the end of the flat 7 which is substantially in excess of the width of its toothed belt 23 and consequently projects from it by a portion 42.

As already described, this projecting portion 42 can advantageously have applied to it a further separate anti-friction rolling bush 43, which reduces contact friction in its resting on the guide 40.

Figure 5C:
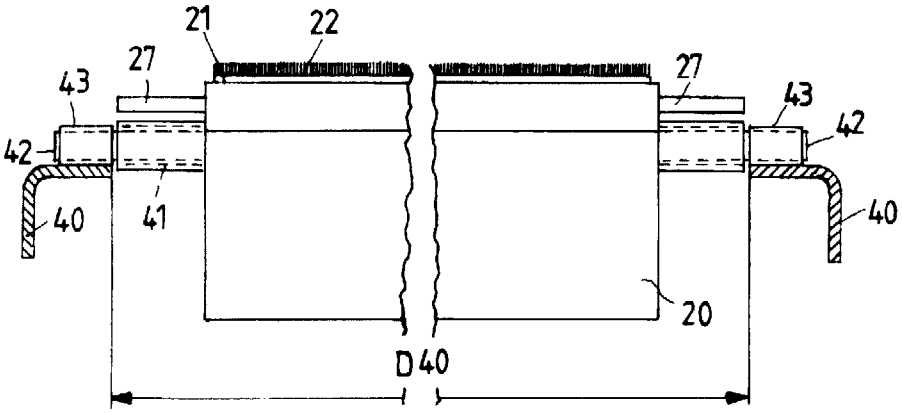
FIG. 5C is a fragmentary cross-sectional view taken through the carding machine, and illustrates axial opposite ends of the coupling pins supported upon guide members through the associated anti-friction bearings.
Figure 6A:
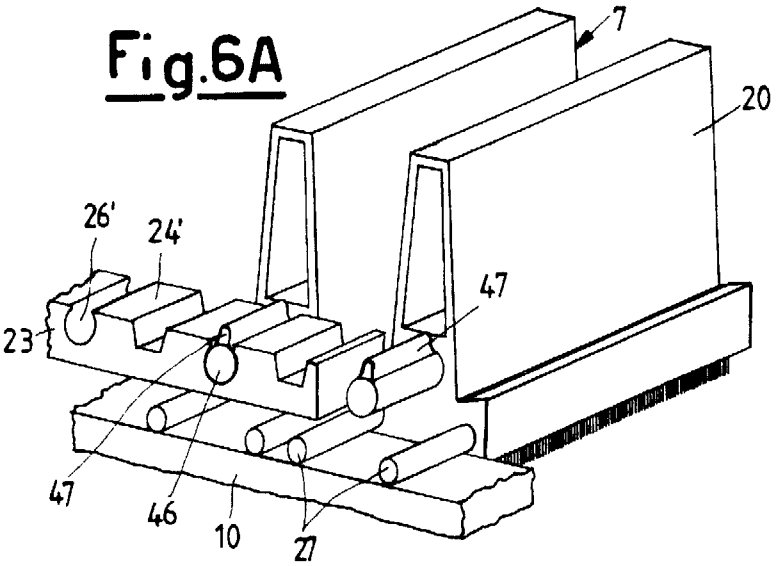
FIG. 6A is a fragmentary perspective view of another embodiment of the invention, and illustrates coupling pins of "pear-shaped" configuration which project beyond upper faces of an associated drive belt.
Figure 6B:
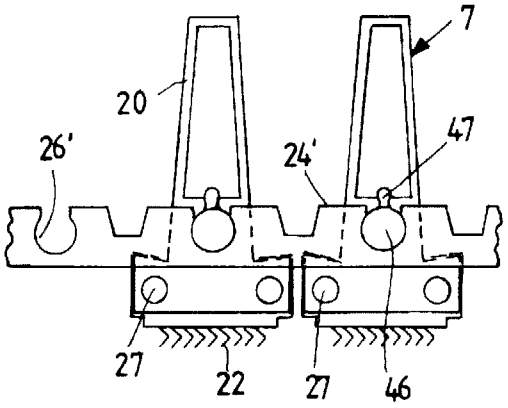
FIG. 6B is a fragmentary side elevational view of the embodiment of the invention illustrated in FIG. 6A, and illustrates details thereof.
Figure 6C:
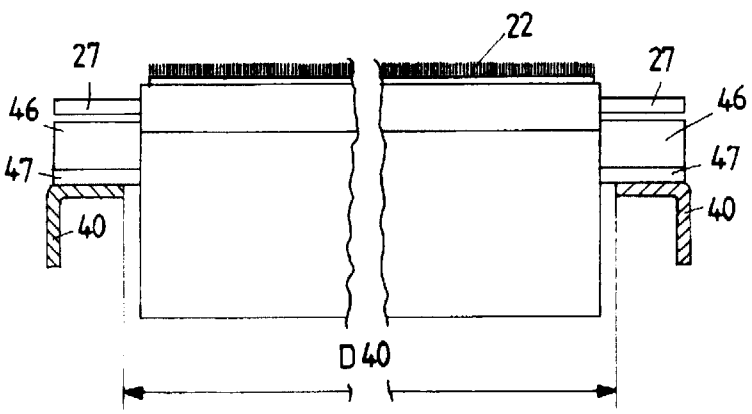
FIG. 6C is a fragmentary side cross-sectional view of the carding machine of FIGS. 6A and 6B, and illustrates the projecting portions guidingly supported upon lateral guiding members.
Figure 6D:
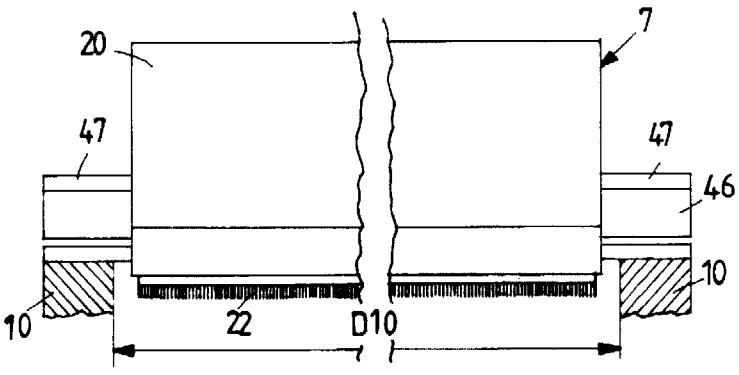
FIG. 6D is a fragmentary transverse cross-sectional view similar to FIG. 6C, and illustrates the flats being guided upon guides associated with the opening cylinder.

In FIG. 5C upper pair of support guides 40 which have to support the weight of the flats 7 along their inoperative path are located at a transverse distance apart $D_{40}$ which is greater than the transverse overall dimension of the pair of belts 23, which corresponds substantially to the distance $D_{10}$ (FIG. 5D) between the guides 10 plus the thickness of the guides themselves, so that the profile of the teeth 24 of the pair of belts 23 remains within guides 40 and does not come into contact with them. The guides 40 are positioned a distance apart $D_{40}$ corresponding to that of the two portions 42 so that it is not the toothed belt which rests on the guides 40 but instead the portion 42, preferably provided with an antifriction bush 43, which slides on the guides or guide members 40 along the inoperative path of the flats 7.

The flats 7, which are supported along the path of the guides 10 by the pins 27, are hence supported along the return path of the guides 40 by the pins 42, with reduced friction and wear. In the embodiment shown in FIGS. 5A through 5D, the cavities/are formed with a closed circular cross-section.

In the embodiment of FIGS. 6A through 6D the type of coupling illustrated in FIGS. 3 is again used, but with the coupling pin 46 between the belt 23 and flat 7 being constructed of "pear" configuration with a small protuberance 47 projecting from the coupling pin 26. Each tooth 24' of the toothed belt 23, has a cavity 26' into which the pin 46 is inserted.

The upper pair of support guides 40 which have to support the weight of the flats 7 along their inoperative path are located at a transverse distance apart $D_{40}$ (FIG. 6C) substantially equal to the distance $D_{10}$ between the guides 10. The projection 47 projects from the teeth 24' such that their contour along the pair of belts 23 remains separated from the guides 40 and does not make contact with them, it being the projection 47 itself, preferably formed of material of good antifriction and antiwear characteristics, which slides on them along the inoperative path of the flats. The flats, which are supported by the pins 27 along the path of the guides 10, are supported along the upper return path of the guides 40 by the pins 46, with reduced friction and wear.

Figure 7B:
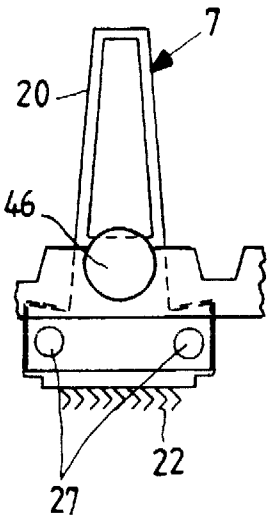
FIG. 7B is a fragmentary perspective view of the embodiment of the invention illustrated in FIG. 7A, and illustrates details thereof.
Figure 7A:
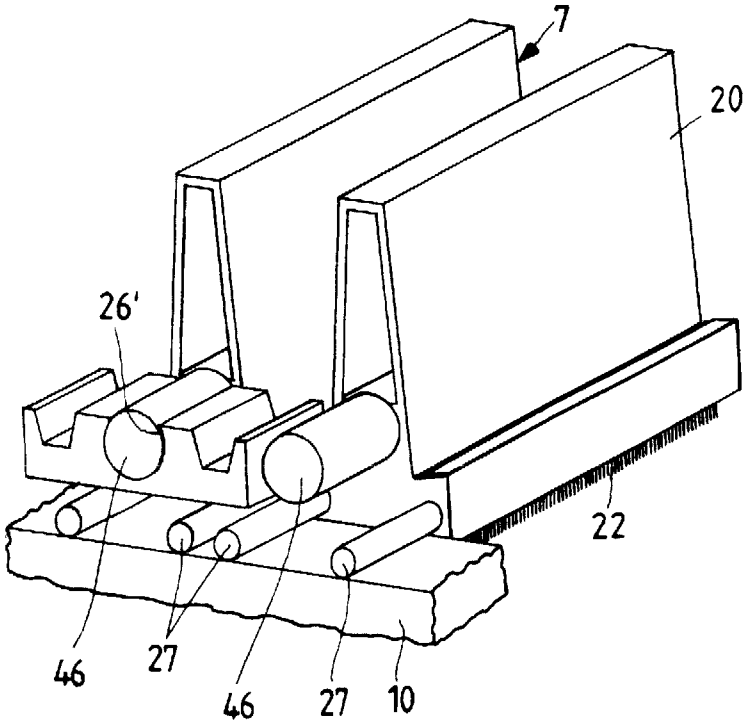
FIG. 7A is a fragmentary perspective view of another embodiment of the invention, and illustrates relative large coupling pins having cylindrical portions projecting beyond an upper face of an associated drive belt.

FIGS. 7A, B show a modification of the coupling of FIGS. 6, in which the cavity 26' into which the pin 46 is inserted has a smaller depth than the pin diameter so that, during the inoperative path of the flat, said pin 46 projects from the belts and raises them, analogously to the embodiment of FIG. 6, so that the pin itself slides on the upper guides instead of the teeth of the belts, with substantial reduction in friction.

Although a preferred embodiment of the invention has been specifically illustrated and described herein, it is to be understood that minor variations may be made in the apparatus without departing from the spirit and scope of the invention, as defined the appended claims.

What is claimed is:

1. A flat carding machine comprising a pair of toothed drive belts (23, 33) in laterally aligned spaced relationship spanned by flats (7) and including upper and lower drive belt flights, each flat (7) including a pair of pins (27, 27) projecting from opposite ends of each flat, said pairs of pins (27, 27) being adapted to support said flat upon laterally spaced guides (10, 10), means (26, 27', 34, 28, 28', 41, 46) for articulately coupling each flat end to an associated drive belt in the absence of fixed retention means, said coupling means including coupling cavities (26, 26', 34) of a substantially cylindrical configuration formed in said drive belts and coupling pins (28, 28', 41, 46) of circular cross-sectional configuration projecting from opposite ends of each flat, and said coupling pins (28, 28', 41, 46) being freely rotatably received in and confined by said coupling cavities (26, 26', 34).

2. The flat carding machine as defined in claim 1 wherein said drive belts are defined by alternating projecting teeth (24) and valley portions (25), and said coupling cavities are formed in said projecting teeth.

3. The flat carding machine as defined in claim 1 wherein said drive belts are defined by alternating projecting teeth (24) and valley portions (25), and said coupling cavities are formed in said valley portions.

4. The flat carding machine as defined in claim 1 wherein said drive belts are defined by alternating projecting teeth (24) and valley portions (25), said coupling cavities are formed in said projecting teeth, each flat includes a lower face (21), and said pairs of pins are closer to said lower face than are said coupling pins.

5. The flat carding machine as defined in claim 1 wherein said drive belts are defined by alternating projecting teeth (24) and valley portions (25), said coupling cavities are formed in said valley portions, each flat includes a lower face (21), and said pairs of pins are closer to said lower face than are said coupling pins.

6. The flat carding machine as defined in claim 1 wherein said drive belts are defined by alternating projecting teeth (24) and valley portions (25), said coupling cavities are formed in said projecting teeth, each flat includes a lower face (21), said pairs of pins are closer to said lower face than are said coupling pins, and portions of said drive belts are sandwiched between said pairs of pins and said coupling pins.

7. The flat carding machine as defined in claim 1 wherein said drive belts are defined by alternating projecting teeth (24) and valley portions (25), said coupling cavities are formed in said valley portions, each flat includes a lower face (21), said pairs of pins are closer to said lower face than are said coupling pins, and portions of said drive belts are sandwiched between said pairs of pins and said coupling pins.

8. The flat carding machine as defined in claim 1 wherein each drive belt includes upper and lower faces, and said cylindrical coupling cavities are cylindrical bores located between said drive belt upper and lower faces.

9. The flat carding machine as defined in claim 1 wherein each drive belt includes upper and lower faces, and said cylindrical coupling cavities are cylindrical bores which also open through said lower faces.

10. The flat carding machine as defined in claim 1 wherein each drive belt includes upper and lower faces, and said cylindrical coupling cavities are cylindrical bores which also open through said upper faces.

11. The flat carding machine as defined in claim 1 including anti-friction means (29) for reducing friction deposited between said coupling pins and said coupling cavities.

12. The flat carding machine as defined in claim 1 including laterally spaced guide members (40) disposed one adjacent each upper drive belt flight, and each coupling pin includes a portion (42, 46, 47) which rests upon an associated guide member (40) during drive belt movement.

13. The flat carding machine as defined in claim 1 wherein each coupling pin is of a substantially pear-shaped transverse cross-sectional relationship.

14. The flat carding machine as defined in claim 1 including laterally spaced guide members (40) disposed one adjacent each upper drive belt flight, each coupling pin includes a portion (42, 46, 47) which rests upon an associated guide member (40) during drive belt movement, and said coupling pin portion (42) projects axially beyond its associated drive belt.

15. The flat carding machine as defined in claim 1 including laterally spaced guide members (40) disposed one adjacent each upper drive belt flight, each coupling pin includes a portion (42, 46, 47) which rests upon an associated guide member (40) during drive belt movement, and said coupling pin portion (46) is a cylindrical portion which projects radially beyond an upper face of an associated drive belt.

16. The flat carding machine as defined in claim 1 including laterally spaced guide members (40) disposed one adjacent each upper drive belt flight, each coupling pin includes a portion (42, 46, 47) which rests upon an associated guide member (40) during drive belt movement, and said coupling pin portion (47) is a narrow axially extending portion projecting radially beyond an upper face of an associated drive belt.

* * * * *